United States Patent [19]

Huertgen

[11] Patent Number: 4,593,552

[45] Date of Patent: Jun. 10, 1986

[54] BUTT SHEAR WITH BUTT KNOCKER

[75] Inventor: Helmut B. Huertgen, Pittsburgh, Pa.

[73] Assignee: Sutton Engineering Co., Pittsburgh, Pa.

[21] Appl. No.: 744,048

[22] Filed: Jun. 12, 1985

[51] Int. Cl.[4] ..... B21C 35/04

[52] U.S. Cl. ..... 72/255; 83/137

[58] Field of Search ..... 72/255; 83/136, 137, 83/150

[56] References Cited

U.S. PATENT DOCUMENTS

| | | | |
|---|---|---|---|
| 1,930,762 | 10/1933 | Leland | 83/136 |
| 3,530,702 | 8/1967 | De Ridder | 72/255 |
| 3,563,079 | 2/1971 | Monie et al. | 72/255 |
| 4,317,352 | 3/1982 | Doudet | 72/255 |

FOREIGN PATENT DOCUMENTS

| | | | |
|---|---|---|---|
| 882836 | 7/1953 | Fed. Rep. of Germany | 72/255 |
| 890814 | 2/1944 | France | 72/255 |

*Primary Examiner*—Lowell A. Larson

*Attorney, Agent, or Firm*—Carothers & Carothers

[57] ABSTRACT

An extrusion press is provided with a butt dislodging apparatus for removal of a billet butt from an extrusion die with the dislodging apparatus including an elongated butt knock-off bar having a free end which is movable within proximity to a butt shear blade and in converging relationship with a shear plane along which the shear blade is movable.

16 Claims, 3 Drawing Figures

BUTT SHEAR WITH BUTT KNOCKER

BACKGROUND OF THE INVENTION

In the metal extrusion arts there are known various extrusion presses for direct or indirect extrusion of a metal billet through an extrusion die. For example, in direct extrusion an elongated billet is held within a through bore in an extrusion container. A dummy block located at the front end of an extrusion stem is inserted into one end of the container bore and a powered ram moves the extrusion stem axially to force the contained billet through a stationary die located in a die carrier or die holder at the opposite end of the container bore. An elongated extruded member is thereby produced. This and other known extrusion operations commonly leave a waste portion of the billet, known as the butt, attached to the die face.

The prior art has provided various means for removing the butt end of a billet from the extrusion die. For example, U.S. Pat. No. 3,530,702 discloses an indirect loose die extrusion press including a cutoff saw which is utilized to separate a major extent of the extruded member from a stud end portion thereof whereby the extrusion is separated from the butt end of the billet. U.S. Pat. No. 3,563,079 discloses a combined direct/indirect extrusion press having a butt shear mounted on the forward platen thereof for shearing the billet butt end from the extrusion die.

The prior art of butt removal has been subject to certain shortcomings. Most significantly, the recent development of recessed weld pocket or feeder plate dies for aluminum extrusion has created a need for more reliable means for butt removal. These dies have a pocket or recess encompassing the extrusion opening on the billet side of the die. Thus, during extrusion operations the aluminum first flows into and fills the weld pocket. This permits a continuous extrusion process as the hot metal contained in the pocket after butt shearing rewelds with the next billet or initiation of the next extrusion cycle. This sort of process, which permits production of extrusions in continuous runs, is suitable only for extrusion of those aluminum alloys which will reweld as described. Other aluminum alloys, and other metals such as brass for example, will not reweld and in this manner therefore are not candidates for use of pocket weld dies.

Economy of cycle time is one primary objective of those extrusion operations which utilize pocket weld dies. Thus, such dies are often used in automated press lines, and often are provided with a number of extrusion openings for producing multiple extrusions from a single extrusion cycle. Accordingly, a die may have several weld pockets formed on its face.

Butt shears, when used in conjunction with such dies, exhibit a tendency to smear a film of the extrusion metal across the face of the die during butt shearing. This may result from misalignment between the die face and the shear blade and can cause undesirable delays in the extrusion operation. For example, for certain modes of shear blade to die face misalignment, a wedging action may result which wedges the shear blade tightly against the die face with hot aluminum from the billet filling the wedge gap between the shear blade and the die face. The shear blade may be so tightly wedged that even the full retraction force of the shear ram will be insufficient to free the shear blade.

Another more common problem associated with the shearing of a butt from a die face is the tendency of the butt to hang up on the shear blade rather than dropping free. Upon retraction of the shear blade, the hung up butt often will adhere to the die face as both the butt and film of metal smeared on the die face by the shearing operation will be quite sticky. Repetition of shear operation to dislodge the stuck butt often is unsuccessful and the butt may ultimately stick so firmly to the die face that extrusion operations must be interrupted to permit replacement of the die and stuck butt with a clean die.

Butt knockoff apparatus for forcefully dislodging a hung-up butt by striking same with an impact tool is known, but these too have been subject to certain shortcomings. For example, known knock-off apparatus, typically has been contained within in the perimeter of the shear actuating ram. This has resulted in unduly complex and difficult to maintain butt shear and knockoff arrangements. Furthermore, in prior butt knockoff structures the motion of the knockoff impact tool has been limited to motion along an axis parallel to the shear plane. This limitation has limited knocker utility as the hungup butt might well be located outside the path of travel of the butt knocker.

BRIEF SUMMARY OF THE INVENTION

The present invention contemplates a novel and improved butt knockoff apparatus which alleviates the above and other shortcomings of the prior art. According to one presently preferred embodiment of the invention, a butt shear is slideably guided on elongated ways for vertical sliding motion along a shear plane which is perpendicular to the extrusion axis of the press. The shear is powered by connection to the free end of a piston rod which extends from a hydraulic cylinder located above the shear such that only the piston rod, and not the shear body which is guided on the elongated ways, is enclosed within the cylinder. The shear body carries a shear blade adjacent its lower end and a butt knockoff apparatus adjacent its outer or frontal side, away from the guide ways which support the shear body. Thus, the shear blade and the butt knockoff apparatus are reciprocally movable in unison along parallel lines of motion extending perpendicular to the extrusion axis. The shear body is mounted on the guideways and extends laterally therefrom such that both the butt knockoff apparatus and the shear blade are readily accessible for maintenance.

The butt knockoff apparatus includes a suitable linear motor such as a hydraulic or air cylinder powered ram which drives an elongated knockoff bar axially at high speed to impact upon a hungup butt for the purpose of dislodging same. The knockoff bar is axially movable with respect to the shear body along a line of motion which converges with the shear plane and intersects same at a location below the shearing edge of the shear blade. Accordingly, upon quick and forceful extension of the knockoff bar the free end of the bar moves into a position of proximity to the shear plane. This angled line of attack of the knockoff bar provides improved knockoff effectiveness in all of the various anticipated and commonly experienced modes of butt hangup, and is especially very effective on thin butts.

It is therefore one general object of the invention to provide an extrusion press with novel and improved butt dislodging apparatus.

A more specific object of the invention is to provide in combination a butt shear and a butt knocker apparatus for dislodging an extrusion butt from an extrusion die after an extrusion cycle by shearing the butt and then knocking the butt off the shear blade before the butt shear returns to its initial position.

A more specific object of the invention is to provide in combination a butt shear and a powered butt knocker bar which is movable along a line of motion that converges with the shear plane.

A further object of the invention is to provide an improved butt shear apparatus wherein a linearly movable butt knockoff member is carried by the shear body for movement along a line of motion which passes in proximity to the shear blade and converges with the shear plane.

These and other objects and further advantages of the invention will be more readily appreciated upon consideration of the following detailed description and the accompanying drawings, in which.

Figure 1:
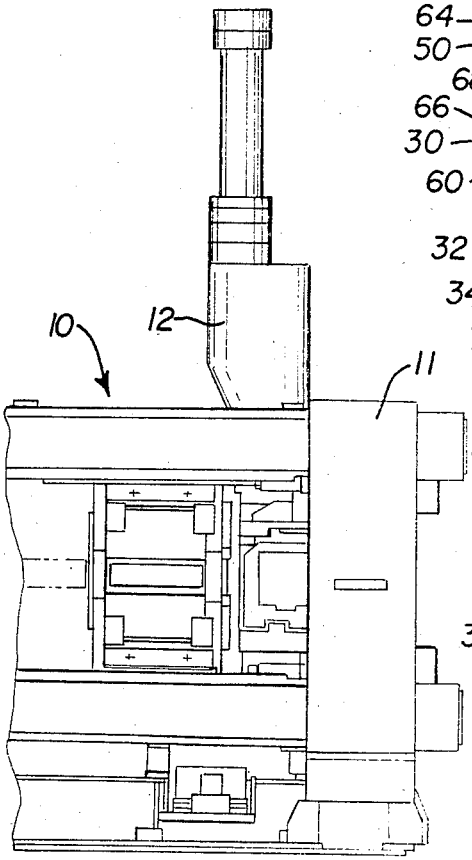
FIG. 1 is a fragmentary side elevation of a direct extrusion press with butt removal apparatus according to the present invention.

There is generally indicated at 10 in FIG. 1 a platen end of an extrusion press having a stationary platen 11 and a butt removal apparatus 12 according to one presently preferred embodiment of the instant invention carried adjacent platen 11. Press 10 is a direct extrusion press, for example, but it will be understood and appreciated that the butt removal apparatus 12 generally may be utilized in any of a wide variety of conventional extrusion press designs and may be mounted with respect to such conventional presses in any of a variety of known or heretofore unknown configurations. It is sufficient for operability of the invention that the butt removal apparatus 12 be positionable with respect to the extrusion die and the attached butt such that the interface between the extrusion die and the butt coincides with the shear plane of the apparatus 12 and the butt is located on the same side of the shear plane as the butt knocker.

Figure 2:
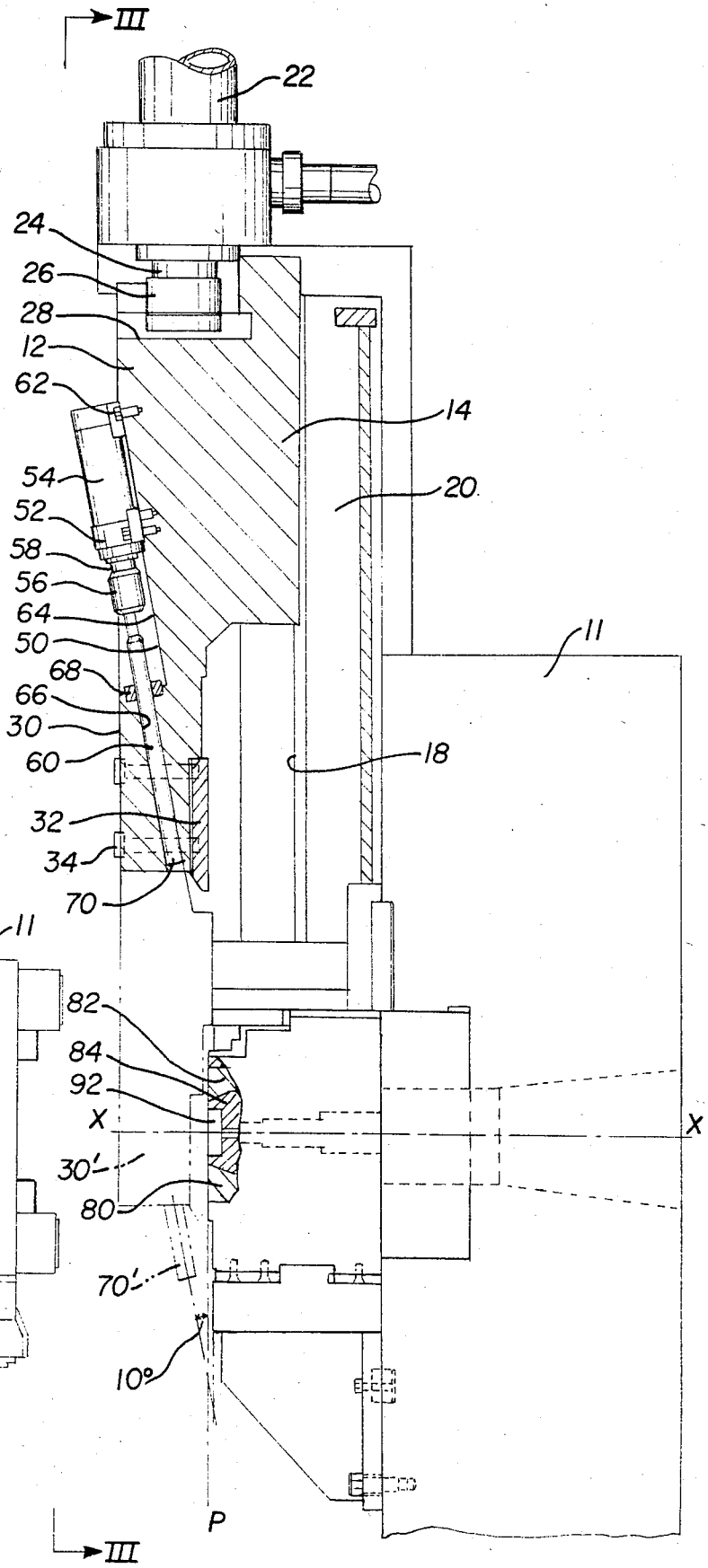
FIG. 2 is an enlarged, detailed portion of FIG. 1 with the extrusion press shown partially in section.
Figure 3:
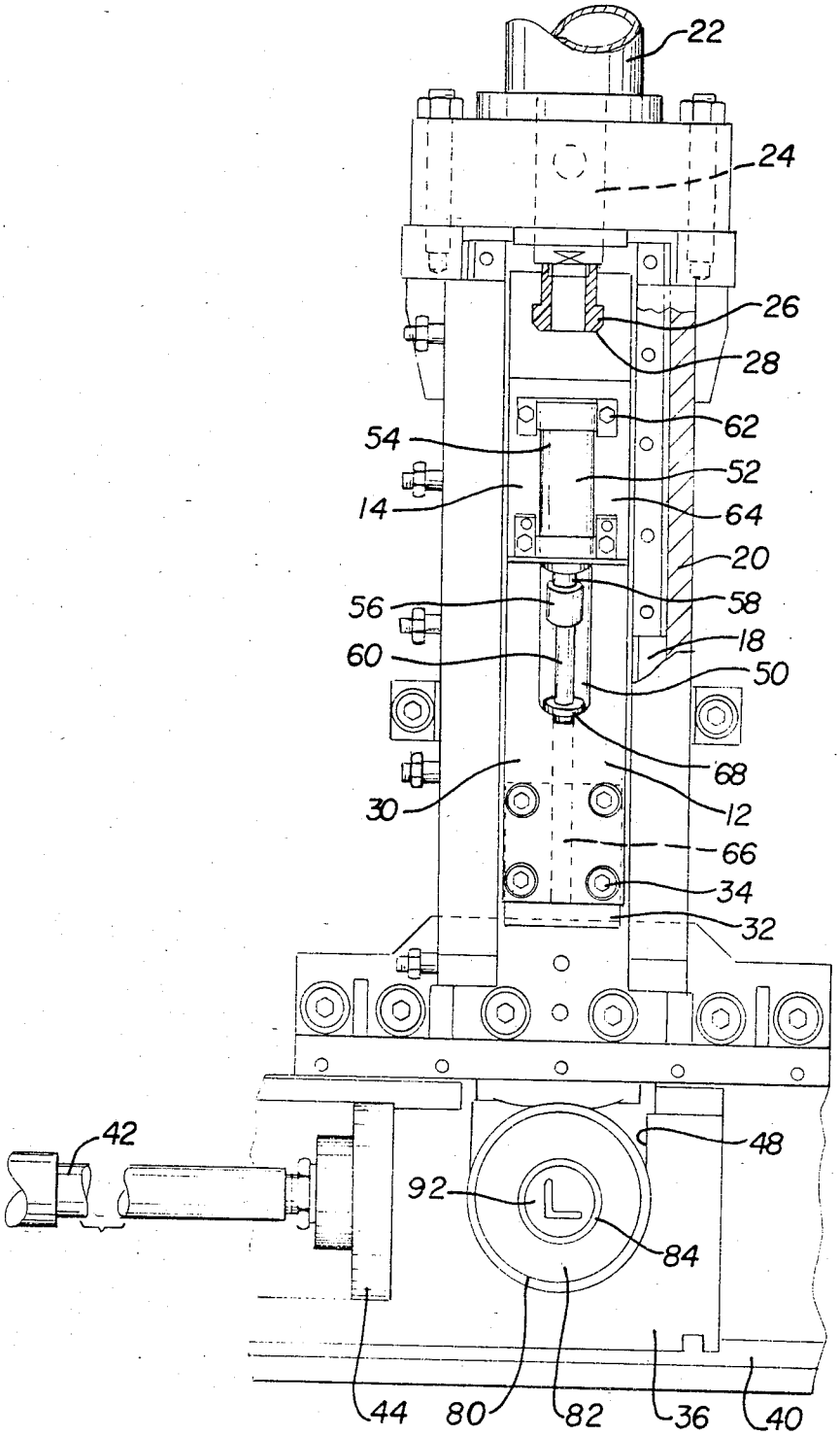
FIG. 3 is a partially sectioned frontal elevation taken on line III—III of FIG. 2.

Referring to FIGS. 2 and 3, apparatus 12 comprises an elongated rigid slide 14 having longitudinally extending guide portions 16 which project laterally in opposite directions and are received in guiding engagement within guideways or channels 18 that extend longitudinally of a rigid shear carrier structure 20 for movement of slide 14 longitudinally on guides 18 perpendicularly toward and away from the extrusion axis X—X of press 10.

Of course, slide 14 is guided with respect to guides 18 by suitably adjustable guide bearing members to permit wear takeup adjustments and alignment of the shear with a shear plane yet to be described.

A double acting fluid operable cylinder 22 is mounted on carrier structure 20 above slide 14 and includes a piston rod 24 which is reciprocable within the cylinder 22 under fluid pressure impetus. A key member 26 secured to the free end of piston rod 24 is captively engaged within a frontally open T-slot 28 formed in the upper end of slide 14 whereby the fluid powered movement of rod 24 moves slide 14 longitudinally of guideways 18.

Slide 14 includes a downwardly projecting forward end portion 30 which releasably carries a shear blade 32 as by removable bolts 34. In the lowermost extreme position of forward end portion 30, shown at 30' in FIG. 2, shear blade 32 completely overlaps the position of the butt (not shown) on the die face. In practice, press 10 may be equipped with a die carrier 36. For example, in FIG. 3, die carrier 36 is a moveable carrier that is laterally slideable on transversely extending guides 40 under the impetus of a fluid powered piston and cylinder assembly 42 that is connected to a cross slide member 44. In turn, member 44 is captively connected to die carrier 36 by any suitable mechanical connection.

As will be seen from FIG. 3, die carrier 36 includes a generally U-shaped, upwardly open recess 48 within which a die assembly 80 is positioned with the interface between the butt and the extrusion die located on the shear plane P. Accordingly, as is well known, the shear blade 32 may be moved across the die face along plane P to shear the butt from the extrusion die. The die assembly 80 may be of any suitable, conventional configuration. As shown, assembly 80 comprises a die holder 82 which receives therein an extrusion die 84 and suitable supporting backup members (not shown). The invention is especially useful for removing a butt from the face of a weld pocket die which has a weld recess 92 as shown. The obstinate butt removal problems which the present invention solves first become appartent with the relatively recent advent of such pocket weld dies.

The frontal face 50 of slide 14 releasably carries a butt knockoff assembly 52 which is comprised of a suitable linear motor 54 such as a hydraulic cylinder or air cylinder assembly, for example, and which includes a chuck 56 carried by the free end of a driven member such as piston rod 58. Chuck 56 captively retains an elongated knockoff bar 60. The assembly 52 is carried by releasable mounting thereof, with bolts 62 or the like, on an inclined recess 64 formed on frontal face 50 of slide 14 such that the assembly 52 mounted thereon extends at an acute angle to the shear plane P. In this configuration, knockoff bar 60 extends within a through bore 66 formed in the forward end 30 of slide 14 and is supported therein by the bore periphery. Additional knockoff bar support such as a cushion 68 may also be provided to take the impact load generated by powered forward travel of bar 60 and thereby reduce impact wear on the cylinder 54.

From FIG. 2 it will be seen that the foreward free end 70 of bar 60, in its retracted position, is adjacent the forwardmost end of slide 14 and in proximity to shear blade 32. When cylinder 54 is actuated to extend bar 60 the forward end thereof projects downwardly to an extended position such as depicted at 70' in FIG. 2. As bar 60 is extended, its free end 70 converges into proximity with the shear plane P whereby the knockoff apparatus is especially well suited to dislodge a butt which is hung up on the tip of the shear blade, or otherwise in close proximity to the shear plane P.

Of course, the knockoff apparatus is operable at any position of the slide 14 which carries it. Preferably, the angle of convergence between shear plane P and the axis of motion of knockoff rod 60 is about 10° as depicted in FIG. 2, but may be in the range of approximately 7° to 20°, depending on press size and extrusion die location.

According to the description hereinabove, the present invention provides for novel and improved means for dislodging a billet butt end in conjunction with an extrusion operation, whereby the economy of the operation is improved through heretofore unavailable efficiency and reliability in butt removal. The invention is especially useful in operations which maximize the tendency for a butt to become hung up in close proximity to the shear plane, and in operations which produce unusually thin butts.

Of course, the inventor has contemplated various alternative and modified embodiments of the invention. For example, a suitably formed implement may be affixed to the free end of the knockoff rod to enhance butt dislodging capability. The butt knockoff apparatus may be inclined to the axis of shear movement in the frontal elevation (FIG. 3) as well as in the side elevation (FIG. 2). Multiple knockoff assemblies, such as pair of knockoff rods which are parallel or which converge toward a point adjacent to the shear plane, are an additional alternative. It is therefore intended that the invention be construed as broadly as permitted by the scope of the claims appended hereto.

I claim:

1. In an extrusion press wherein a butt dislodging means is provided with a shear blade that is movable with respect to the extrusion axis of the press along a shear plane to shear the butt of a metal billet from the face of an extrusion die subsequent to an extrusion operation, the improvement in said butt dislodging means comprising:

a selectively operable butt knockoff means which is movable in unison with said shear blade wherein said knockoff means includes a knockoff member which is carried in a manner to be extendable with respect to said shear blade along a line of motion which passes in proximity to said shear blade and converges with said shear plane.

2. The improvement as claimed in claim 1 wherein said knockoff member is an elongated member having a free end and said elongated member is movable along said line of motion to an extreme position whereat said free end is proximate said shear plane.

3. The improvement as claimed in claim 2 wherein said knockoff means additionally includes a selectively operable linear motor for moving said elongated member along said line of motion.

4. The improvement as claimed in claim 3 wherein said linear motor and said elongated member are aligned on an inclined axis which converges with said shear plane.

5. The improvement as claimed in claim 4 wherein the angle of convergence between said inclined axis and said shear plane is in the range of approximately 7° to approximately 20°.

6. The improvement as claimed in claim 5 wherein said angle of convergence is approximately 10°.

7. In an extrusion press wherein a butt dislodging means is movable transversely with respect to the extrusion axis of the press to dislodge the butt of a metal billet from the face of an extrusion die subsequent to an extrusison operation, said butt dislodging means comprising:

guide means carried by said press;

a slide carried on said on said guide means for selective reciprocal movement along said guides transversely of the extrusion axis of said press;

a shear blade carried by said slide for movement with said slide along a shear plane that is coincident with the face of such a die for shearing such a butt from the face of such an extrusion die; and elongated butt knockoff means carried by said slide and including an elongated member which is selectively movable with respect to said slide along a line of motion which passes in proximity to said shear blade and converges with said shear plane.

8. The butt dislodging means as claimed in claim 7 wherein said member includes a free end which is selectively movable along said line of motion to an extreme position whereat said free end is in proximity to said shear plane.

9. The butt dislodging means as claimed in claim 8 wherein said knockoff means additionally includes motor means for reciprocally driving said elongated member along said line of motion.

10. The butt dislodging means as claimed in claim 9 wherein said motor means is carried by said slide adjacent a frontal portion thereof at a position displaced laterally from said guide means.

11. In an extrusion press for the extrusion of aluminum forms from aluminum billets, a billet butt removal apparatus comprising:

a slide carried by guides for reciprocal movement perpendicularly to the axis of extrusion of such an extrusion press;

first motive means for selectively moving said slide along said guides;

said slide including a forward end portion which is selectively movable into and out of an overlapping relationship with the extrusion axis of such press upon actuation of said first motive means;

a shear blade carried by said forward end portion for movement therewith along a shear plane;

means for positioning a die and an attached butt end of a billet with the interface therebetween on said shear plane;

a butt knocker means carried by said slide and movable in concert therewith;

said butt knocker means including an elongated member which extends on an axis in converging relationship with said shear plane; and said butt knocker means including second motive means which is cooperable with one end of said elongated member to propel said elongated member on said axis for selectively moving the opposite end of said elongated member into proximity with said shear plane.

12. The apparatus as claimed in claims 11 wherein said axis extends in proximity to said shear blade and intersects said shear plane at a point displaced forwardly of said shear blade.

13. The apparatus as claimed in claims 12 wherein said second motive means is a high speed fluid operable cylinder assembly.

14. The apparatus as claimed in claim 13 wherein said second motive means is a hydraulic ram.

15. The apparatus as claimed in claim 14 wherein said butt knocker means is carried by a frontally open portion of said slide laterally displaced from said guides.

16. The apparatus as claimed in claim 15 additionally including cushion means carried by said slide for cushioning the axial travel of said elongated member.

* * * * *